United States Patent [19]

Moller et al.

[11] Patent Number: 4,608,698

[45] Date of Patent: Aug. 26, 1986

[54] ELECTRIC HEAT TREATING FURNACE WITH QUICKLY SERVICEABLE HEATING ASSEMBLY COMPONENTS

[75] Inventors: Craig A. Moller, Loves Park; Eric H. Wolter, Cherry Valley, both of Ill.

[73] Assignee: Abar Ipsen Industries, Feasterville, Pa.

[21] Appl. No.: 648,493

[22] Filed: Sep. 10, 1984

[51] Int. Cl.[4] ..... H05B 3/08

[52] U.S. Cl. ..... 373/130; 373/114; 373/125; 373/137; 174/15 BH; 174/153 R

[58] Field of Search ..... 373/111, 113, 114, 130, 373/137, 109, 110, 112, 119, 125, 126; 174/15 BH, 152 R, 153 R

[56] References Cited

U.S. PATENT DOCUMENTS 3,150,226 9/1964 Thorne et al. ..... 373/130
3,737,553 6/1973 Kreider et al. ..... 373/130
4,286,111 8/1981 Massey et al. ..... 174/15 BH
4,429,403 1/1984 Hooper ..... 373/111

*Primary Examiner*—Roy N. Envall, Jr.
*Attorney, Agent, or Firm*—Leydig, Voit & Mayer, Ltd.

[57] ABSTRACT

A heat treating furnace in which an electrical resistance heating element is disposed in a chamber and is energized by way of a power feed through conductor which extends slidably through the wall of the furnace. An insulating washer and a retaining washer may be installed on and removed from the inner end portion of the feed through conductor from inside the furnace without either removing the conductor from the furnace wall or disconnecting the conductor from the heating element. A power terminal block and inlet and outlet lines for cooling water are adapted to be quickly and easily disconnected from the outer end portion of the feed through conductor to permit the conductor to be easily pulled inwardly through the furnace wall for servicing.

9 Claims, 9 Drawing Figures

ELECTRIC HEAT TREATING FURNACE WITH QUICKLY SERVICEABLE HEATING ASSEMBLY COMPONENTS

BACKGROUND OF THE INVENTION

This invention relates to a heat treating furnace of the type in which electric resistance heating elements are disposed within a work chamber to radiantly heat workpieces in the chamber. The work chamber is defined within a walled enclosure preferably having an outer wall and having radiation sheilding packs attached to the inner side of the outer wall.

To supply electrical power to the heating elements, elongated rigid conductors extend through the wall of the furnace. The inner end portion of each power feed through conductor is connected to one end of a heating element while the outer end portion of each conductor carries a terminal block adapted to be connected to a source of voltage for energizing the heating element. To dissipate heat from the power feed through conductor, cooling water is circulated through the conductor by means of inlet and outlet lines connected to the conductor.

Each power feed through conductor extends slidably through a hole in the furnace wall so that the conductor may be removed from the wall for repair or replacement. An insulating washer on the inner end portion of the conductor insulates the heating element electrically from the wall and provides thermal insulation around the hole through which the conductor extends. In some heat treating furnaces, the insulating washers become coated with metal which is vaporized during the heat treating process and, after some period of use, the washers tend to lose their insulating characteristics. Thus, the insulating washers must periodically be removed from the furnace and replaced with new washers.

SUMMARY OF THE INVENTION

The general aim of the present invention is to provide a new and improved furnace in which the insulating washers may be quickly and easily replaced on the feed through conductors from inside of the furnace and without need of either removing the conductors from the furnace wall or disconnecting the conductors from the heating elements.

A more detailed object is to achieve the foregoing by the provision of novel radially slit insulating washers and by the provision of retaining washers of a unique construction which permits the insulating and retaining washers simply to be slipped radially into encircling relation with the conductors and then locked securely in place.

Another object of the invention is to provide a furnace in which the power terminal block and the inlet and outlet lines for the cooling water are adapted to be quickly and easily disconnected from the outer end portion of each feed through conductor in order to permit the conductor to be easily pulled inwardly through the furnace wall from inside the furnace when it is necessary either to repair or replace the conductor or the heating element which is connected to the conductor.

These are other objects and advantages of the invention will become more apparent from the following detailed description when taken in conjunction with the accompanying drawings.

DETAILED DESCRIPTION

Figure 1:
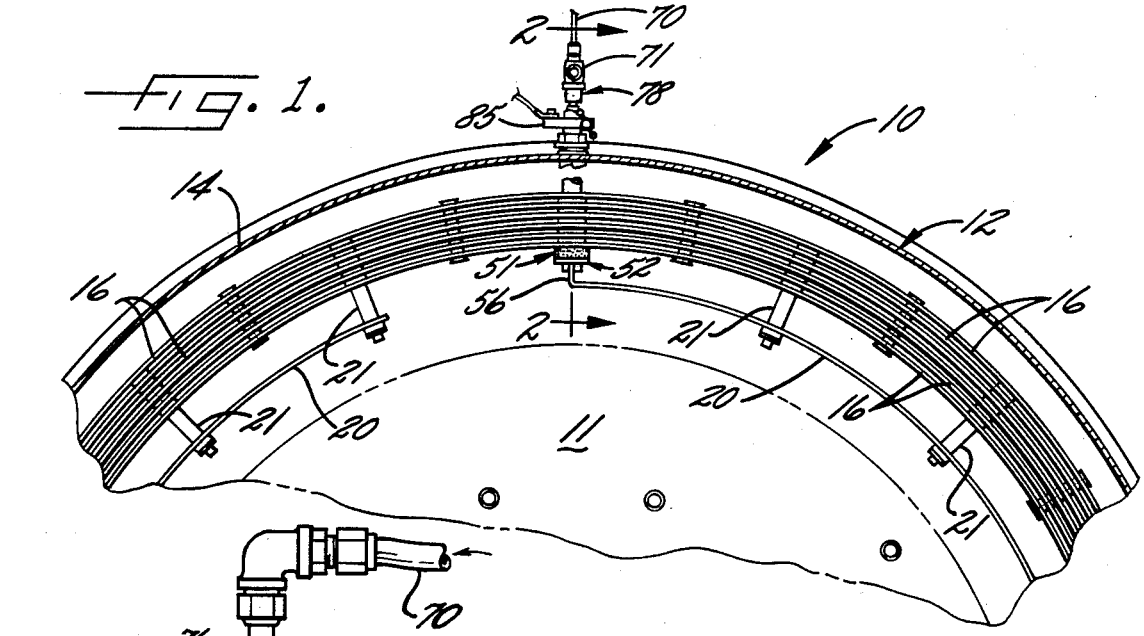
FIG. 1 is a fragmentary cross-sectional view taken transversely through a new and improved electric heat treating furnace incorporating the unique features of the present invention.

For purposes of illustration, the invention is shown in the drawings in conjunction with a vacuum furnace 10 for heat treating workpieces (not shown) in a chamber 11. The chamber is defined within a walled enclosure 12 of circular cross-section and formed in part by an outer shell or wall 14. Radially spaced radiation shields 16 made of high temperature metal are secured to the inner side of the outer wall 14 to insulate the chamber 11 from the outer wall.

Heating of the workpieces is effected by an array of electrical resistance heating elements spaced axially from another within the chamber 11, there being only one heating element 20 shown in the drawings. The heating element is in the shape of a circular split band and is formed from a thin strip of metal. Several electrically insulated hanger rods 21 (FIG. 1) suspend the heating element from the shields 16 and hold the heating element in spaced relationship with the innermost shield. That shield reflects radiation from the heating element back into the chamber 11.

The heating element 20 is adapted to be energized by current flow from a voltage source 25 (shown schematically in FIG. 2) connected across the two ends of the heating element. For simplicity, only the connection between the voltage source and one end of the heating element has been shown in the drawings. It should be appreciated that a similar connecting arrangement is provided at the other end of the heating element.

Figure 2:
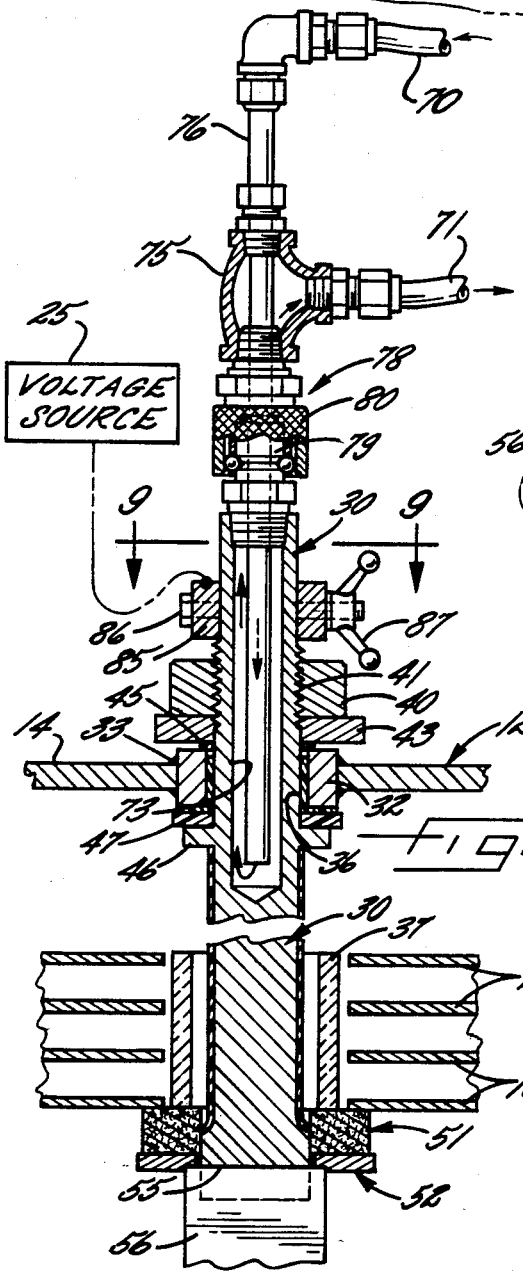
FIG. 2 is an enlarged fragmentary cross-section taken substantially along the line 2—2 of FIG. 1.

As shown most clearly in FIG. 2, the connection between the voltage source 25 and the heating element 20 is effected in part by a power feed through conductor 30 which is in the form of an elongated rigid metal rod of circular cross-section. The power feed through conductor 30 extends slidably through a cylindrical mounting sleeve 32 which, in turn, extends through the wall 14 and is welded rigidly to the wall 14 at 33 (FIG. 2). A Teflon insulating sleeve 36 (FIG. 2) is disposed between the mounting sleeve and the conductor to insulate the conductor electrically from the mounting sleeve. A ceramic insulating sleeve 37 disposed within the shields 16 receives the inner end portion of the conductor, the latter projecting inwardly a short distance beyond the innermost shield.

The conductor 30 is prevented from sliding inwardly by an outer retainer in the form of a lock nut 40 (FIG. 2). Part of the outer portion of the conductor is threaded as indicated at 41 in FIG. 2 in order to accommodate the lock nut. The lock nut overlies a washer 43 which, in turn, engages an insulating seal 45 located adjacent the outer end of the sleeve 32. When tightened, the nut causes a flange 46 on the conductor to clamp against the inner end of the sleeve 32, there being an insulating disc 47 between the flange and the sleeve.

An insulating washer 51 made of Kaowool or the like is located against the inner side of the innermost shield 16 to provide thermal insulation around the opening through the shield and to insulate the heating element 20 electrically from the shield. A retaining washer 52 made of stainless steel holds the insulating washer in place.

The present vacuum furnace 10 is especially adapted for use in the fluxless brazing of aluminum parts. During the brazing operation, a quantity of magnesium is vaporized in the furnace chamber 11 in order to scavenge free gases from the chamber and to promote the flow of the brazing material. When the magnesium subsequently condenses, some of the magnesium tends to collect on and coat the insulating washer 51. When the washer becomes heavily coated, it loses its insulating qualities and must be replaced.

In accordance with one aspect of the present invention, the insulating washer 51 and the retaining washer 52 are uniquely constructed so as to enable the insulating washer and the retaining washer to be placed on and removed from the feed through conductor 30 from inside the furnace 10 and without need of removing the conductor from the mounting sleeve 32 or disconnecting the conductor from the heating element 20. As a result, the insulating washer may be replaced quickly and easily when the washer becomes coated with magnesium or otherwise loses its effectiveness.

Figure 3:
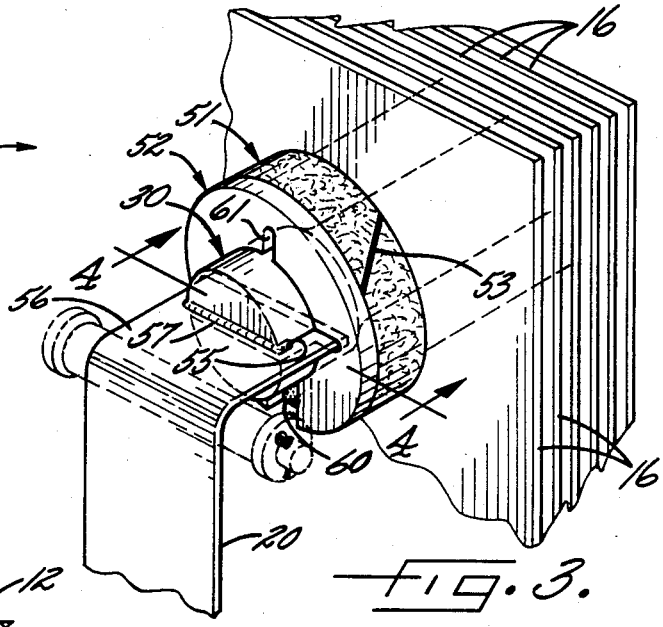
FIG. 3 is a fragmentary perspective view showing a heating element connected to a power feed through conductor and showing the insulating washer and the retaining washer associated with the conductor.
Figure 5:
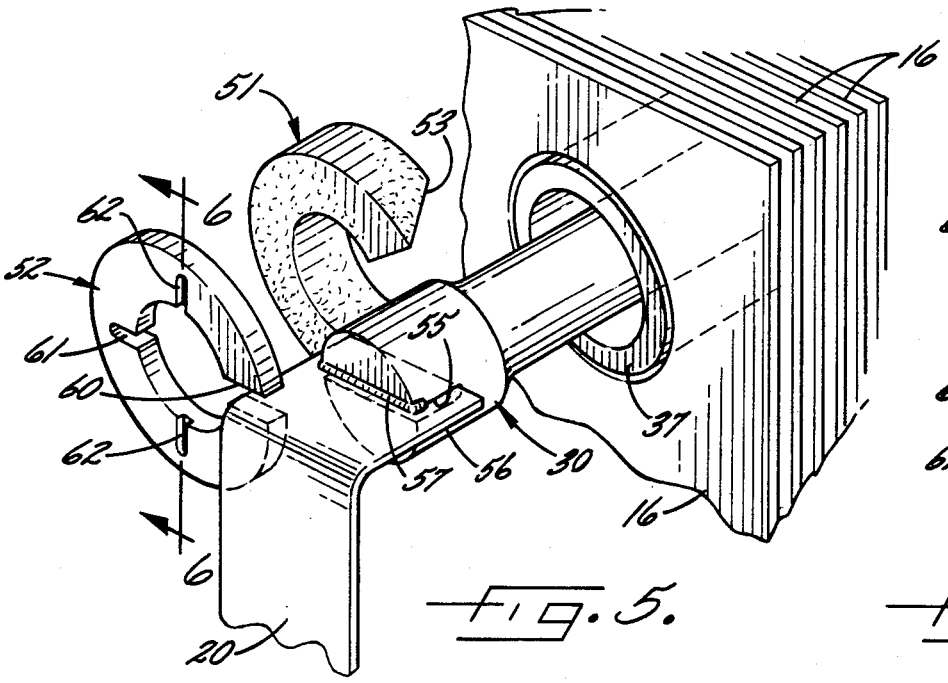
FIG. 5 is an exploded perspective view showing the insulating washer and the retaining washer just prior to being installed on the conductor.

More specifically, the insulating washer 51 is simply slit along one side as indicated at 53 in FIGS. 3 and 5. Thus, the flexible Kaowool washer may be momentarily separated at the slit and then slipped radially over the inner end portion of the feed through conductor 30 (see FIG. 5). If desired, the ends of the washer adjacent the slit may be glued together after the washer has been slipped radially over the conductor. To provide gluing surfaces of relatively large area, the slit is cut on an angle such as the 45 degree angle shown in FIGS. 3 and 5.

Figure 4:
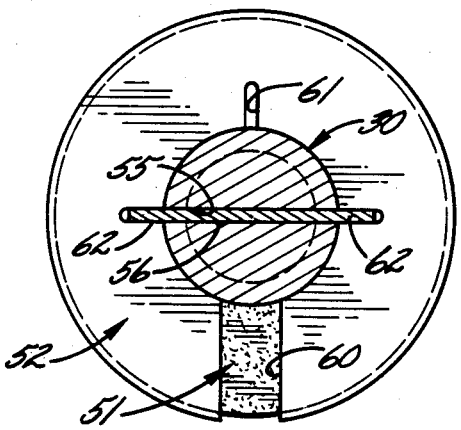
FIG. 4 is an enlarged cross-section taken substantially along the line 4—4 of FIG. 3 and shows the insulating washer and the retaining washer installed on the conductor and locked in place.

Before describing the novel construction of the retaining wahser 52, the connection between the heating element 20 and the inner end of the conductor 30 will be explained. As shown in FIGS. 3 and 4, the inner end portion of the conductor is formed with a diametrically extending slot 55 which opens out of the inner end of the conductor and out of diametrically opposite sides thereof. The end portion of the heating element is formed with a flat mounting tongue 56 extending radially outwardly from the overall circular configuration of the element and sized to fit within the slot. As shown in FIG. 4, the width of the mounting tongue 56 is greater than the diameter of the inner end portion of the conductor 30 and thus the sides of the tongue project radially beyond the sides of the conductor. The tongue 56 is welded within the slot 55 as indicated at 57 in FIG. 3 in order to establish a good electrical and mechanical connection between the heating element 20 and the conductor 30.

Figure 6:
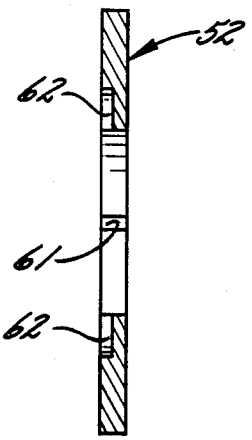
FIG. 6 is an enlarged cross-section taken along the line 6—6 of FIG. 5.

In carrying out the invention, the inner diameter of the retainer washer 52 is somewhat less than the width of the mounting tongue 56 of the heating element 20 and is just slightly greater than the diameter of the inner end portion of the conductor 30. To enable the retainer washer 52 to be installed on the conductor 30, a radially extending slit 60 is formed through one side of the retainer washer, the circumferential width of the slit 60 being greater than the thickness of the mounting tongue 56. In addition, a radially extending notch 61 (FIG. 5) which opens into the inner diameter of the retainer washer is formed through the retainer washer at a position diametrically opposite the slit 60. For a purpose to be described subsequently, two detent grooves 62, each spaced ninety degrees from the slit 60, are formed in the inner face of the retainer washer and also open into the inner diameter thereof. Unlike the notch 61, however, the detent grooves 62 do not extend through the thickness of the washer (see FIG. 6).

With the foregoing arrangement, the insulating washer 51 is installed in the manner previously described by slipping the insulating washer radially over the inner end portion of the conductor 30 in a position adjacent the innermost shield 16. Thereafter, the retainer washer 52 is slipped radially over that portion of the tongue 56 located inwardly of the inner end of the conductor 30 (see FIG. 5). The slit 60 in the retainer washer permits the latter initially to be slipped radially over the tongue while the notch 61 subsequently receives the left side margin of the tongue to permit the retainer washer to be slipped sufficiently far to the right to cause the inside diameter of the washer to be located coaxial with the conductor.

After the retainer washer 52 has been located in coaxial relation with the conductor 30, it is slid outwardly along the tongue 56 and onto the conductor. The retainer washer then is slid outwardly past the outer end of the tongue to free the slit 60 and the notch 61 from the tongue and to position the inner face of the retainer washer adjacent the outer end of the tongue (see FIGS. 7 and 8). During such sliding, the resilienty yieldable Kaowool material of the insulating washer 51 is compressed by the retainer washer 52 and thus the insulating washer acts as a spring to urge the retainer washer inwardly.

Figure 7:
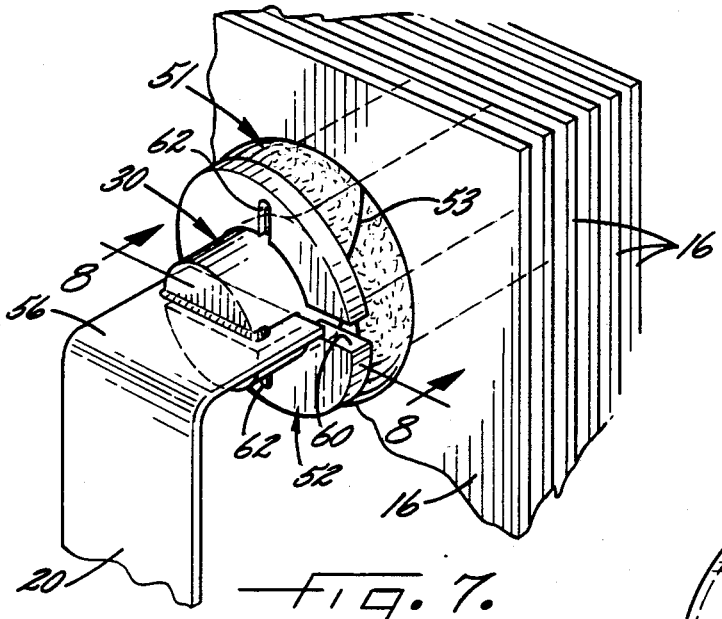
FIG. 7 is a perspective view similar to FIGS. 3 and 5 but shows the insulating washer and the retaining washer after being installed on the conductor and before being locked in place.
Figure 8:
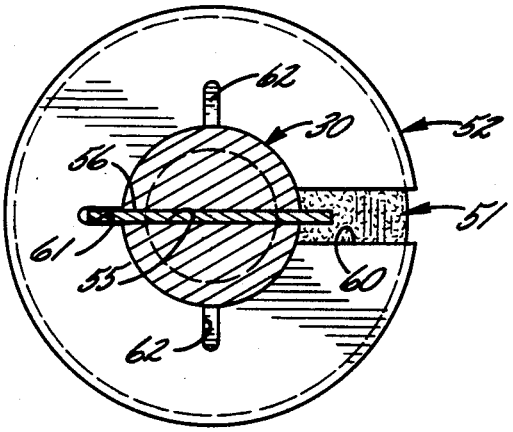
FIG. 8 is an enlarged cross-section taken substantially along the line 8—8 of FIG. 7.

The final step of the installation involves turning the retainer washer 52 clockwise through ninety degrees from the position shown in FIGS. 7 and 8 to the position shown in FIGS. 3 and 4. As an incident thereto, the detent grooves 62 are rotated into angular alinement with the outer ends of the radially projecting side portions of the tongue 56. When axial pressure subsequently is released from the retainer washer, the compressed insulating washer 51 urges the retaining washer outwardly to cause the detent grooves 62 to key against the outer ends of the side portions of the tongue (see FIG. 4). As a result, further turning of the retainer washer is prevented and both it and the insulating washer are held securely in place.

When the insulating washer 51 requires replacement, the detent grooves 62 may be released from the tongue 56 by pushing the retainer washer 52 outwardly against the bias of the insulating washer. Thereafter, the retainer washer may be turned through ninety degrees to the position shown in FIGS. 7 and 8 and moved inwardly along the tongue to free the insulating washer for radial removal from the conductor 30.

From the foregoing, it will be apparent that the insulating washer 51 may be installed on and removed from the feed through conductor 30 from inside the furnace 10. There is no need to disconnect the heating element 20 from the feed through conductor or to remove the conductor from the wall 14 and the shields 16 when the insulating washer is replaced. Moreover, no tools are required to release and re-lock the retainer washer 52.

In order to dissipate heat from the power feed through conductor 30, the latter is cooled by water flowing into the conductor from a water inlet line 70 (FIG. 2) and flowing out of the conductor through a water outlet line 71, both lines being formed by flexible hoses. An elongated axially extending passage 73 is formed in the center portion of the conductor to accommodate the flow of cooling water through the conductor. The passage is closed at the inner end portion of the conductor.

In accordance with another aspect of the invention, the inlet and outlet lines 70 and 71 are adapted to be quickly disconnected from the conductor 30 in order to enable the conductor to be pulled inwardly through the mounting sleeve 32 and into the furnace chamber 11 when the conductor and/or the heating element 20 require repair and/or replacement. In addition, the conductor may be quickly disconnected from the voltage source 25 when it becomes necessary to pull the conductor from the mounting sleeve and into the chamber.

More specifically, the outlet line 71 is connected into the side of a pipe tee fitting 75 (FIG. 2) in a conventional manner. The inlet line 70, however, is connected to a rigid pipe 76 secured to the outer end of the tee 75, extending through the tee and having an open end located adjacent the closed end of the passage 73. The pipe also extends slidably and with substantial radial clearance through a quick disconnect coupling 78 having a tubular plug 79 threaded into the outer end of the conductor 30 and having a tubular socket 80 threaded into the inner end of the tee. The quick disconnect coupling itself is of conventional construction and may be a Hansen Series ST straight through coupling.

With the foregoing arrangement, cooling water flows into the passage 73 in the conductor 30 by way of the inlet line 70 and the pipe 76. After being discharged from the open end of the pipe, the water flows reversely in the passage along the outside of the pipe and through the coupling 78, into the tee 75 and then out of the outlet line 71. If it becomes necessary to pull the conductor 30 inwardly through the mounting sleeve 32, the socket 80 of the quick disconnect coupling 78 may be quickly unsnapped from the plug 79 to permit the tee 75 to be separated from the conductor, the pipe 76 being pulled out of the passage 73 during separation of the tee. The outer diameter of the plug 79 of the coupling 78 is less than the inner diameter of the mounting sleeve 32 and thus, after the plug has been separated from the socket 80, the conductor and the plug may be pulled inwardly through the sleeve without being obstructed by the water lines.

Figure 9:
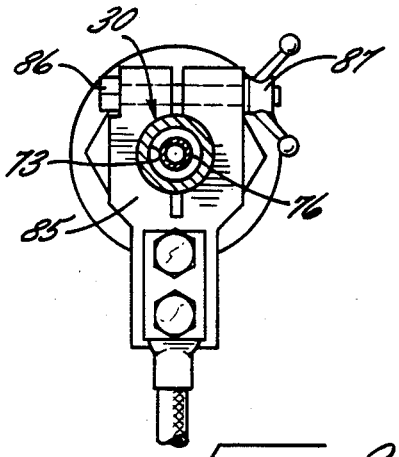
FIG. 9 is a fragmentary cross-section taken substantially along the line 9—9 of FIG. 2.

The voltage source 25 is connected to the outer end portion of the conductor 30 by a terminal block in the form of a split collar 85 (FIGS. 2 and 9) which is telescoped over the outer end portion of the conductor. The collar forms a quick-disconnect coupling and is adapted to be clamped to the conductor when a bolt 86 is tightened by a hand crank 87. By turning the crank, the bolt may be quickly loosened to unclamp the collar and enable the collar to be slipped off of the outer end of the conductor so that the latter may be pulled inwardly through the mounting sleeve 32.

We claim:

1. An electric heat treating furnace comprising wall means defining a work chamber, an electric resistance heating element disposed within said chamber and operable when energized to heat workpieces disposed in said chamber, means located outside of said chamber for energizing said heating element, and a rigid conductor extending slidably through said wall means and connecting said heating element electrically to said energizing means, said conductor having an inner end portion connected to an end of said heating element, the improvement in said furnace comprising, a retaining washer encircling the inner end portion of said conductor and located between the end of said heating element and said wall means, and an insulating washer encircling the inner end portion of said conductor and engaging said retaining washer, said retaining washer and said insulating washer each being formed with a substantially radially extending slit and each being movable into and out of encircling relationship with the inner end portion of said conductor from within said chamber without taking said conductor out of said wall means and without disconnecting said conductor from said heating element.

2. An electric heat treating furnace as defined in claim 1 further including a terminal collar telescoped over the outer end portion of said conductor, said terminal collar connecting said conductor electrically to said energizing means, a releasable retainer telescoped over the outer end portion of said conductor between said terminal collar and the outer side of said wall means and preventing said conductor from sliding inwardly of said wall means, and means for quickly clamping said collar to and unclamping said collar from said conductor whereby said collar and said retainer may be removed from said conductor to permit the conductor to be pulled inwardly through said wall means.

3. An electric heat treating furnace as defined in claim 2 in which a water passage is formed in said conductor, an inlet line for introducing cooling water into said passage, an outlet line for discharging water from said passage, and a quick disconnect coupling connecting said inlet and outlet lines to the outer end portion of said conductor and adapted to be quickly disconnected from said conductor to permit the conductor to be pulled inwardly through said wall means.

4. An electric heat treating furnace comprising wall means defining a work chamber, an electric resistance heating element disposed within said chamber and operable when energized to heat workpieces disposed in said chamber, means located outside of said chamber for energizing said heating element, and a rigid conductor extending slidably through said wall means and connecting said heating element electrically to said energizing means, said conductor having an inner end portion connected rigidly to an end portion of said heating element, said furnace being characterized by the inner end portion of said conductor being substantially circular in cross-section and by the end portion of said heating element being in the form of a substantially flat tongue having a side portion projecting radially beyond the adjacent side of the inner end portion of said conductor, a retaining washer encircling the inner end portion of said conductor and engaging the end of said heating element, said washer having a slit extending substantially radially through one side of the washer, said slit having a circumferential width less than the diameter of the inner end portion of said conductor and greater than the thickness of said tongue whereby said retaining washer may be installed and captivated on said conductor by slipping said washer radially onto said tongue, by sliding said washer outwardly past the outer end of said one side of said tongue and onto said conductor, and then by turning said washer angularly to move said slit out of angular alinement with the outer end of said one side of said tongue, an insulating washer encircling the inner end portion of said conductor and captivated between said retaining washer and said wall means, said insulating washer being formed with a substantially radially extending slit and being movable radially into and out of encircling relationship with the inner end portion of said conductor.

5. An electric heat treating furnace as defined in claim 4 in which said insulating washer is resiliently compressible and acts between said wall means and said retaining washer to urge said retaining washer inwardly against the outer end of said tongue.

6. An electric heat treating furnace as defined in claim 5 in which a detent groove is formed in the inner face of said retaining washer and is spaced angularly from the slit in the retaining washer, said detent groove receiving the outer end of said tongue after said retaining washer has been slid outwardly onto said conductor and turned angularly, said detent groove thereafter keying said retaining washer against further turning.

7. An electric heat treating furnace as defined in claim 4 in which the width of said tongue is greater than the diameter of the inner end portion of said conductor, the inner diameter of said retaining washer being greater than the diameter of the inner end portion of said conductor and being less than the width of said tongue, the inner end portion of said conductor being formed with a radially extending slot which opens out of the inner end of said conductor and out of diametrically opposite sides thereof, said tongue being disposed in said slot with the sides of the tongue projecting radially beyond the sides of the inner end portion of said conductor, and a radially extending notch formed through said retaining washer and extending from the inner diameter of the retaining washer, said notch being located diametrically opposite from the slit in said retaining washer and receiving said tongue when said retaining washer is slipped radially onto said tongue.

8. An electric heat treating furnace as defined in claim 7 further including a pair of diametrically spaced detent grooves formed in the inner face of said retaining washer and each spaced ninety degrees from said notch, said detent grooves receiving the outer end of said tongue after said retaining washer has been slid outwardly onto said conductor and turned angularly through ninety degrees, said detent grooves thereafter keying said retaining washer against further turning.

9. An electric heat treating furnace as defined in claim 8 in which said insulating washer is resiliently compressible and is compressed between said wall means and said retaining washer, said insulating washer urging said retaining washer inwardly and causing said detent grooves to key against the outer end of said tongue.

* * * * *